United States Patent [19]

Ichikawa et al.

[11] Patent Number: 4,724,336

[45] Date of Patent: Feb. 9, 1988

[54] POWER CIRCUIT FOR THERMAL HEAD

[75] Inventors: Takashi Ichikawa; Yoshinori Iida; Katsumi Uematsu; Noriyasu Tajima, all of Shizuoka, Japan

[73] Assignee: Tokyo Electric Co., Ltd., Tokyo, Japan

[21] Appl. No.: 905,926

[22] Filed: Sep. 10, 1986

[30] Foreign Application Priority Data

Sep. 19, 1985 [JP] Japan ..... 60-207283

[51] Int. Cl.[4] ..... H05B 1/02

[52] U.S. Cl. ..... 307/150; 400/120; 346/76 PH; 219/216; 101/93.04

[58] Field of Search ..... 307/150; 400/120; 346/76 PH; 219/216, 216 PH; 101/93.04

[56] References Cited

U.S. PATENT DOCUMENTS

| | | | |
|---|---|---|---|
| 3,874,493 | 4/1975 | Boyd | 346/76 PH X |
| 4,268,838 | 5/1981 | Nakano et al. | 219/216 PH X |
| 4,488,827 | 12/1984 | Haganuma | 400/120 X |
| 4,496,824 | 1/1985 | Kawai | 219/216 |
| 4,500,893 | 2/1985 | Sakura et al. | 400/120 X |
| 4,511,903 | 4/1985 | Miyazaki et al. | 346/76 PH |
| 4,532,523 | 7/1985 | Tanaka | 219/216 PH X |
| 4,535,340 | 8/1985 | Moriguchi et al. | 346/76 PH |
| 4,540,991 | 9/1985 | Kariya et al. | 219/216 PH X |
| 4,563,691 | 1/1986 | Noguchi | 346/76 |
| 4,573,058 | 2/1986 | Brooks | 346/76 PH |
| 4,587,530 | 5/1986 | Noguchi | 219/216 PH X |
| 4,651,166 | 3/1987 | Katsuragi | 346/76 PH |

FOREIGN PATENT DOCUMENTS

| | | | |
|---|---|---|---|
| 3139321 | 4/1982 | Fed. Rep. of Germany . | |
| 58-201681 | 11/1983 | Japan . | |
| 0007068 | 1/1984 | Japan | 219/216 PH |

*Primary Examiner*—William M. Shoop, Jr.
*Assistant Examiner*—Shik Luen Paul Ip
*Attorney, Agent, or Firm*—Oblon, Fisher, Spivak, McClelland, & Maier

[57] ABSTRACT

Resistance of a thermal head is stored as a digital signal in a head resistance memory. Output according to data in the head resistance memory is calculated by a head voltage calculation circuit for storing a correlation between resistance of the thermal head at a fixed normal temperature and supply voltage. The output from the head voltage calculation circuit is converted by a D/A converter to a reference voltage, which is then fed to a constant-voltage power source for applying the supply voltage to the thermal head, so that an optimum supply voltage to the thermal head may be automatically set, and temperature of the thermal head generating heat may be maintained constant.

4 Claims, 3 Drawing Figures

POWER CIRCUIT FOR THERMAL HEAD

FIELD OF THE INVENTION AND RELATED ART STATEMENT

The present invention relates to a thermal printer for conducting heat transfer printing, and more particularly to a power circuit for a thermal head which may supply a constant voltage to the thermal head of the thermal printer.

FIG. 3 shows an exemplary power circuit for a thermal head in the prior art. As shown in FIG. 3, there is provided a constant-voltage power source 2 connected to an astable power source 1. The constant-voltage power source 2 is connected to a thermal head (not shown). A thermistor 3 for detecting temperature of the thermal head is connected at a connection mid-point between the constant-voltage power source 2 and the thermal head. The thermistor 3 is connected in series with a semi-fixed resistor 4 and a temperature correction resistor 5 connected in series with the semi-fixed resistor 4. The resistor 5 is connected to the constant-voltage power source 2 at the other end. Thusly, a constant level voltage is supplied to the thermal head by the constant-voltage power source 2 on the basis of a reference power of a battery 2*a* of the constant-voltage power source 2. At this time, resistance of the thermistor 3 is changed according to temperature of the thermal head. Accordingly, the temperature of the thermal head and voltage to be applied to the thermal head are regulated to thereby maintain the temperature of the thermal head constant. In the case of freely setting temperature of the thermal head, a relation between a change in temperature of the thermal head and resistance thereof is collated with a table to adjust the semi-fixed resistor 4 and change the voltage to be applied to the thermal head.

However, the conventional power circuit as mentioned above has the following problems, that is, an operational problem and a functional problem. In the operational problem, there exist two points due to manual operation of the semi-fixed resistor 4. That is to say, there is a possibility that the semi-fixed resistor 4 is erroneously operated because of erroneous collation of the table. In the other point, the semi-fixed resistor 4 is difficult to finely adjust. Further, there also exist two points in the functional problem. First, since the thermistor 3 employed for the purpose of maintaining temperature of the thermal head constant is inaccurately operated originally, the temperature of the thermal head is easily changed. Secondly, in the case that a plurality of thermal heads are provided, it is necessary to independently provide power circuits for the thermal heads from the viewpoint of constitution of the power circuit. As a result, the number of parts is increased to render a structure complicated. Further, in the case that each of heat generating devices in the thermal head is independently controlled, it is necessary to similarly provide each power circuit for each of the heat generating devices.

OBJECT AND SUMMARY OF THE INVENTION

It is a first object of the present invention to provide a power circuit for a thermal head, which may automatically set an optimum supply voltage.

It is a second object of the present invention to provide a power circuit for a thermal head, which may securely maintain temperature of the thermal head as set once.

It is a third object of the present invention to provide a power circuit for a thermal head, which may allow common use of parts in the case that plural thermal heads or heat generating devices are independently controlled, without providing any completely independent circuits per each of the thermal heads or the heat generating devices.

According to the present invention, there are provided a head resistance memory for detecting and storing resistance of a thermal head and a head voltage calculation circuit for storing a correlation between resistance of the thermal head at a fixed normal temperature and voltage to be applied to the thermal head, and generating an output according to data in the head resistance memory. The head voltage calculation circuit is connected through a D/A converter to a constant-voltage power source for supplying voltage to the thermal head. As a result, an optimum supply voltage according to the resistance of the thermal head is applied to the thermal head. Accordingly, a supply voltage to be applied to the thermal head is automatically regulated. Simultaneously, temperature of the thermal head is maintained at a constant value. Further, in the case that a plurality of head resistance memories are provided in accordance with a plurality of thermal heads, and each of the head resistance memories is connected through each of gate circuits to the head voltage calculation circuit, and a control circuit for selectively opening and closing the gate circuits with a timing lag is connected to the gate circuits, so as to control the plurality of thermal heads, any parts such as the head voltage calculation circuit and the constant-voltage power source may be used in common.

DESCRIPTION OF PREFERRED EMBODIMENT

Figure 1:
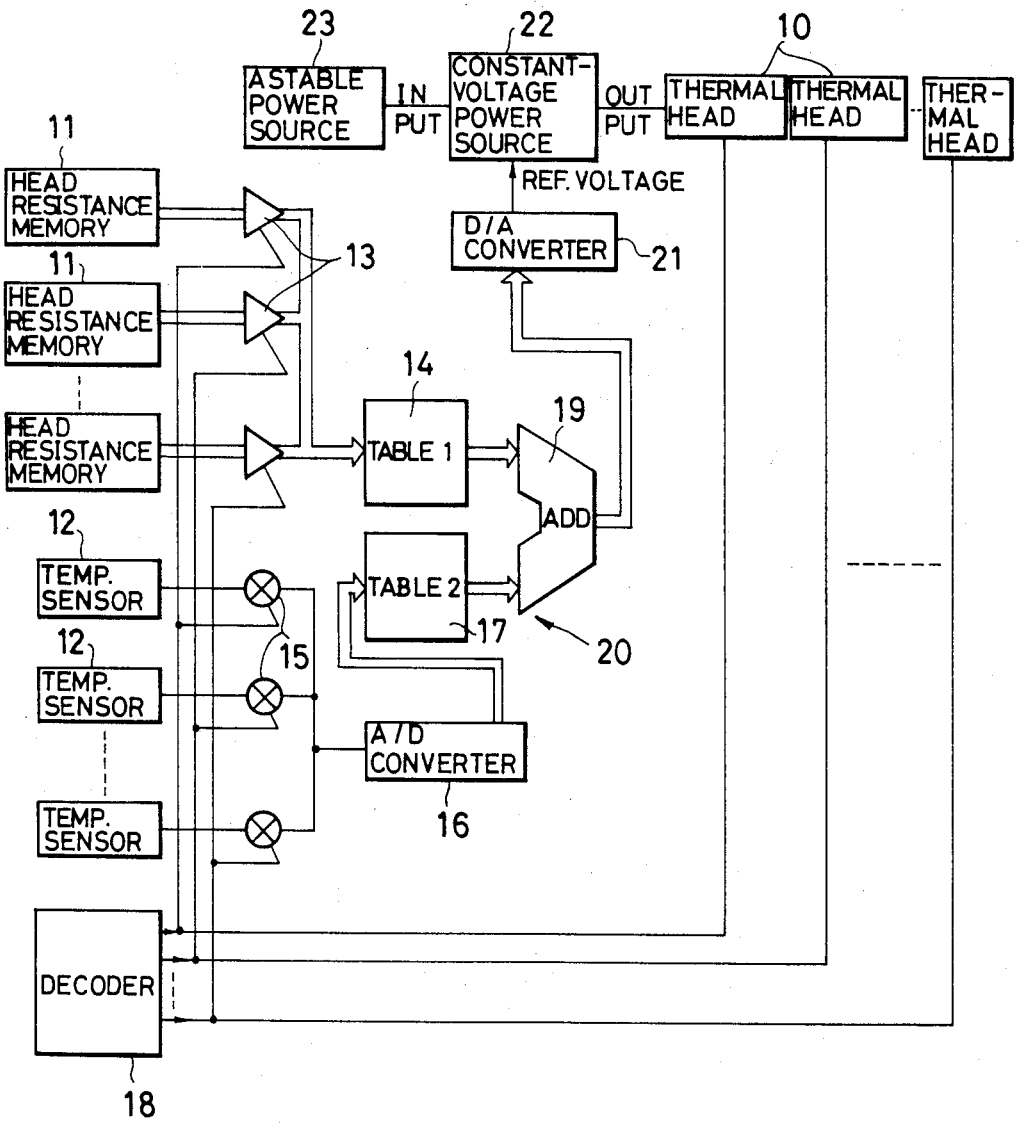
FIG. 1 is a general block diagram showing a preferred embodiment of the present invention.
Figure 2:
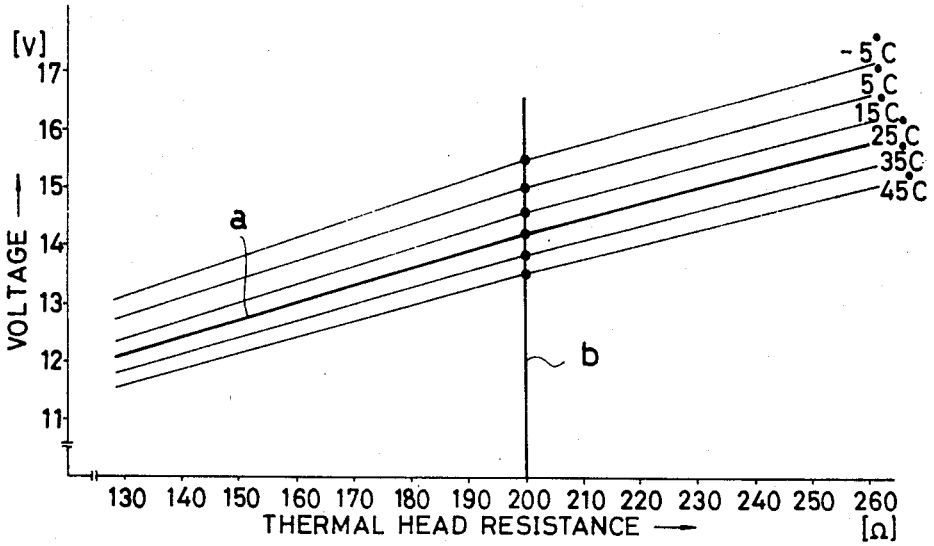
FIG. 2 is a graph showing a correlation between resistance of the thermal head and supply voltage with respect to various temperatures.
Figure 3:
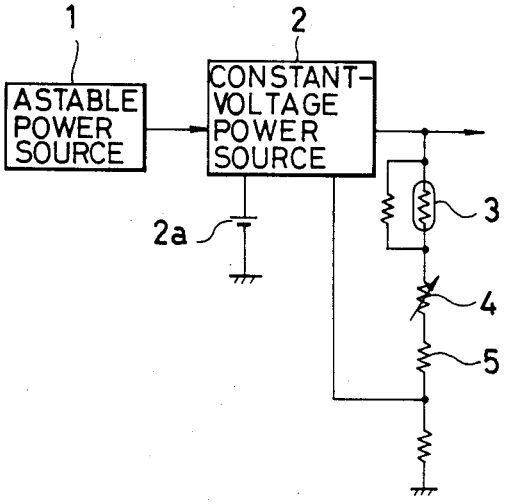
FIG. 3 (PRIOR ART)
FIG. 3 is a circuit diagram of a power circuit in the prior art.

Referring to FIGS. 1 and 2 which show a preferred embodiment of the present invention, there are provided a plurality of thermal heads 10, head resistance memories 11 for storing resistance of the thermal heads 10, and temperature sensors 12 for detecting temperature of the thermal heads 10. The head resistance memories 11 are connected through gate circuits 13 to an input side of a $table_1$ 14, and the temperature sensors 12 are connected through analog switches 15 as a gate circuit and an A/D converter 16 to an input side of a $table_2$ 17. A decoder 18 as a control circuit is provided to selectively open and close the gate circuits 13 and the analog switches 15. The decoder 18 is connected to the gate circuits 13 and the analog switches 15, and is also connected to the thermal heads 10. Each of output sides of the $table_1$ 14 and the $table_2$ 17 is connected to an input side of an adder 19. The adder 19, the $table_1$ 14 and the $table_2$ 17 constitute a head voltage calculation circuit 20, which will be hereinafter described in detail. An output side of the head voltage calculation circuit 20, that is, an output side of the adder 19 is connected through a D/A converter 21 to an input side of a constant-voltage power source 22. The constant-voltage power source 22 is supplied with voltage from an astable power source 23, and an output side of the constant-voltage power source 22 is connected to the thermal heads 10.

There will be now described details of the head voltage calculation circuit 20. The table$_1$ 14 stores voltage corresponding to resistance (e.g., about 130–260Ω) of the thermal heads 10 at a fixed normal temperature (e.g., about 25° C. ), and generates the voltage as a supply voltage $V_{tr}$. On the other hand, the table$_2$ 17 stores an amount of change in the supply voltage corresponding to a change in temperature (e.g., −5°–45° C. ) of the thermal heads 10 at a reference resistance (e.g., 200Ω) of the thermal heads 10, and generates the amount of change in the supply voltage as a voltage $V_t$. The adder 19 sums up the supply voltage $V_{tr}$ and the voltage $V_t$ to generate a total amount $V_h$.

With this arrangement, the thermal heads 10 are supplied with voltage from the astable power source 23 to generate heat. In the course of heat generation, the voltage applied to the thermal heads 10 is maintained at a constant level by the constant-voltage power source 22, thereby providing an ideal heat generating condition of the thermal heads 10, and controlling to maintain such a condition. In other words, the condition of the thermal heads 10 is detected by the head resistance memories 11 and the temperature sensors 12. A reference voltage according to the condition is formed by the head voltage calculation circuit 20 and the D/A converter 21, and is applied to the constant-voltage power source 22.

In operation, resistance of the thermal heads 10 is stored as a digital signal by the head resistance memories 11 corresponding to the respective thermal heads 10, and temperature of the thermal heads 10 is detected by the temperature sensors 12 corresponding to the respective thermal heads 10. If the gate circuits 13 and the analog switches 15 are open, these data are fed to the head voltage calculation circuit 20. Thus, the supply voltage $V_{tr}$ is obtained in the table$_1$ 14. At this time, the relation between the resistance of the thermal heads 10 and the supply voltage $V_{tr}$ is shown by a curved line a in FIG. 2. On the other hand, the voltage $V_t$ is obtained in the table$_2$ 17. At this time, the relation between the temperature of the thermal heads 10 and the voltage $V_t$ is plotted on a straight line b in FIG. 2. Then, the supply voltage $V_{tr}$ and the varied voltage $V_t$ are summed up by the adder 19. The output $V_h$ from the adder 19 is allowed to pass through the D/A converter 21, and is converted to a reference voltage. The reference voltage is applied to the constant-voltage power source 22 to regulate the voltage to be applied to the thermal heads 10. In this manner, the heat generating condition of the thermal heads 10 is automatically regulated to an ideal condition, and this ideal condition is automatically maintained. In addition, such automatic regulation and automatic maintenance are greatly accurately conducted since the correlation between resistance of the thermal heads 10 and voltage to be applied to the thermal heads 10 is invariant, and an error due to a change in temperature of the thermal heads 10 is corrected by adding an amount of the change in temperature of the thermal heads 10 to a detection result.

Signals for opening and closing the gate circuits 13 and the analog switches 15 are generated from the decoder 18. When the decoder 18 receives a select signal for selecting any of the thermal heads 10, it generates an opening/closing signal according to the select signal. Accordingly, the gate circuits 13 and the analog switches 15 are opened and closed with a timing lag per each of the corresponding thermal heads 10. Accordingly, it is not necessary to provide independent power circuits for the plurality of thermal heads 10, and particularly, it is possible to use any parts such as the constant-voltage power source 22 to thereby render a structure simple.

In a modified embodiment, the head resistance memories may be provided for a plurality of heat generating devices (not shown) in a single thermal head 10 to independently control each of the heat generating devices.

What is claimed is:

1. A power circuit for a thermal head comprising:

a head resistance memory for storing resistance of said thermal head as a digital signal;

a temperature sensor for detecting temperature of said thermal head;

an A/D converter for converting an output from said temperature sensor;

a head voltage calculation circuit including a first table addressed by said head resistance memory for storing a correlation between resistance of said thermal head at a fixed normal temperature and supply voltage, a second table addressed by said A/D converter sensor for storing a correlation between temperature at a reference resistance of said thermal head and the supply voltage, and means for calculating an output according to data outputted from said first and second tables;

a D/A converter for converting an output from said head voltage calculating circuit to a reference voltage; and a constant-voltage power source for generating a constant voltage based on said reference voltage to said thermal head.

2. A power circuit comprising:

a plurality of head resistance memories for storing resistances of a plurality of thermal heads;

a plurality of temperature sensors for detecting temperatures of said thermal heads;

an A/D converter for converting an output from said temperature sensors;

a head voltage calculation circuit including a first table addressed by one of the head resistance memories for storing a correlation between resistances of said thermal heads at a fixed normal temperature and supply voltages, a second table addressed by one of the temperture sensors for storing a correlation between temperatures at a reference resistance of said thermal head and the supply voltage, and means for calculating an output according to data outputted by said first and second tables;

a plurality of gate circuits for selectively coupling said one of said head resistance memories and said one of said temperature sensors to said first and second tables, respectively;

a control circuit for selectively opening and closing said gate circuits;

a D/A converter for converting an output from said head voltage calculation circuit to a reference voltage; and a constant-voltage power source for generating a constant voltage based on said reference voltage to said thermal heads.

3. The power circuit as defined in claim 2, wherein a head selecting signal for selecting operation of said thermal heads is fed to said control signal to selectively open and close said gate circuits according to said head selecting signal.

4. The power circuit as defined in claim 2, wherein said constant-voltage power source is singly provided for use in common.

* * * * *